US006067403A

United States Patent [19]

Morgandi

[11] Patent Number: 6,067,403

[45] Date of Patent: May 23, 2000

[54] HOUSEHOLD ELECTRICAL STEAM GENERATOR WITH STABILIZED BOILER WATER LEVEL, PARTICULARLY FOR SMOOTHING IRONS

[75] Inventor: Arturo Morgandi, Bergamo, Italy

[73] Assignee: Imetec, S.p.A., Azzano S. Paolo, Italy

[21] Appl. No.: 08/927,166

[22] Filed: Sep. 11, 1997

[30] Foreign Application Priority Data

May 6, 1997 [IT] Italy ..... BG97A0020

[51] Int. Cl.[7] ..... F22B 1/28; D06F 75/06

[52] U.S. Cl. ..... 392/401; 392/324; 38/77.6

[58] Field of Search ..... 392/394, 396, 392/397, 400, 401, 402, 403, 405, 324, 325, 326, 328, 333; 38/77.6–77.9, 77.3, 85; 261/66, 67, 68, 70

[56] References Cited

U.S. PATENT DOCUMENTS

| | | | |
|---|---|---|---|
| 1,932,447 | 10/1933 | Caplan | 392/401 |
| 3,267,678 | 8/1966 | Camp | 122/489 |
| 3,436,852 | 4/1969 | Stansbury | 38/77.6 |
| 3,660,635 | 5/1972 | Liebert | 392/401 |
| 3,786,829 | 1/1974 | Nardo et al. | 137/202 |
| 3,809,374 | 5/1974 | Schossow | 392/402 |
| 5,189,726 | 2/1993 | Pan | 38/77.6 |
| 5,307,440 | 4/1994 | Carretto | 392/402 |
| 5,832,639 | 11/1998 | Muncan | 38/77.6 |
| 5,881,207 | 3/1999 | DeBourg et al. | 392/401 |

FOREIGN PATENT DOCUMENTS

| | | | |
|---|---|---|---|
| 0438112 | 7/1991 | European Pat. Off. | D06F 75/02 |
| 0595292 | 5/1994 | European Pat. Off. | F22B 1/28 |
| 0795720 | 9/1997 | European Pat. Off. | F22B 1/28 |
| 2691233 | 11/1993 | France | F22D 5/34 |
| 3627988 | 4/1987 | Germany | F22B 1/28 |
| 92162908 | 4/1993 | Germany | A47J 31/44 |
| 4304532 | 8/1994 | Germany | F24F 6/10 |

*Primary Examiner*—Sam Paik
*Attorney, Agent, or Firm*—Steinburg & Raskin, P.C.

[57] ABSTRACT

In this household electrical steam generator, particularly for smoothing irons, the water level within the boiler is stabilized by electronic and/or pneumatic action, electronic action being actuated by a temperature sensor positioned on that portion of the body of a usual armoured resistance element which is subject to emergence following reduction in the water level, to activate a make-up micro-pump transferring into the boiler cold water drawn from a reservoir, pneumatic action being actuated by a floating valve enabling air to enter during boiler cooling, in order not to enable the boiler to draw water from the reservoir through the body of the halted micro-pump.

20 Claims, 7 Drawing Sheets

22
21
24
19
18
25
23
20

HOUSEHOLD ELECTRICAL STEAM GENERATOR WITH STABILIZED BOILER WATER LEVEL, PARTICULARLY FOR SMOOTHING IRONS

BACKGROUND OF THE INVENTION

This invention relates to a household electrical steam generator with stabilized boiler water level, particularly for smoothing irons. Steam is known to be increasingly used in modern homes, namely for floor, armchair, bath and curtain cleaning, and in particular for ironing. Such steam is generally produced in a water container comprising an electrical resistance heater, the heat of which vaporizes the water until temperature sensors (thermostats) or pressure sensors (pressure switches) deactivate it to prevent explosion deriving from excess pressure. The widespread domestic use of steam has led to a considerable technological development of this sector, such that there currently exist a large number of technical expedients aimed at creating increasingly more perfect and more economical household electrical steam generators, with the scope of leading the commercial competition between the numerous manufacturers. Hence just small details can make that added difference defining an excellent product offering low cost and high performance. For their periodical filling with water, most boilers are provided with a robust plug which is screwed into and unscrewed from the boiler body. To prevent burn-out of the water-heating electrical resistance element as a result of its excessive temperature rise, devices are used for indicating an insufficient water quantity remaining in the boiler. Following this indication, the boiler plug must be unscrewed and a given quantity of cold water poured into the boiler. Because the residual water itself generates steam, this plug unscrewing becomes a dangerous operation as the violent steam exit can scald the hands. There is a like danger in pouring the cold water into the boiler, because its contact with the very hot walls can result in spitting causing scalding. This typical method of filling usual boilers has a further serious drawback, namely that of feeding into the boiler a large quantity of cold water which requires a considerable time to be heated and converted into steam. This results in a non-continuous steam availability. To reduce the number of fillings, the boiler would have to be very large, but this theoretical solution has limits not only because of the said drawback of the lengthy waiting time for the water to be heated, but also because of the fact that the larger the internal volume of the boiler, the greater the elastic energy which it can contain and hence the greater the danger in the case of explosion. Moreover the greater the boiler volume the greater must its wall thickness be for the same pressure as a smaller boiler. This means a greater boiler cost and a weight which becomes inconvenient. To avoid these drawbacks, various technical attempts have been made to separate the actual boiler from the cold water reservoir, but these have proved unsatisfactory from the cost and reliability viewpoint. In these types of generator there is moreover the drawback that the pump forms a "channel" for water transit from the reservoir to the boiler when this latter is subjected to the typical vacuum caused by cooling. In this respect, this causes excessive water filling of the boiler which, when the boiler is again switched on not only results in an increased heating time, but also in initial very hot water spitting before steam can be emitted at the correct quality. This spitting is caused by the reduction or absence, in the boiler, of a free water surface necessary for its vaporization. In most boilers, the heating resistance element is switched on and off by usual bimetallic thermostats, or by pressure switches which deactivate it on reaching a limiting pressure which must not be exceeded in order not to risk explosion. However these control devices have too wide a range of action and are of poor reliability, and are hence unsatisfactory.

OBJECTS AND SUMMARY OF THE INVENTION

An object of the present invention is to provide a household electrical steam generator able to provide a large steam quantity from a small boiler. A further object is to provide a steam generator as the aforesaid, which from the commencement of delivery provides steam without water droplets mixed with it. A further object is to provide a steam generator as the aforesaid, which uses particularly precise temperature control devices. A further object is to provide a steam generator as the aforesaid, which uses low-cost temperature control devices which are reliable with time. These and further objects will be seen to have been attained on reading the following detailed description, which illustrates a household electrical steam generator, particularly for smoothing irons, characterised in that the water level within the boiler is stabilized by electronic and/or pneumatic action, electronic action being actuated by a temperature sensor positioned on that portion of the body of a usual armoured resistance element which is subject to emergence following reduction in the water level, to activate a make-up macro-pump transferring into the boiler cold water drawn from a reservoir, pneumatic action being actuated by a floating valve enabling air to enter during boiler cooling, in order not to enable the boiler to draw water from the reservoir through the body of the halted micro-pump.

BRIEF DESCRIPTION OF THE DRAWINGS

The invention is illustrated by way of non-limiting example on the accompanying drawings, in which.

DETAILED DESCRIPTION OF THE PREFERRED EMBODIMENTS

Figure 1:
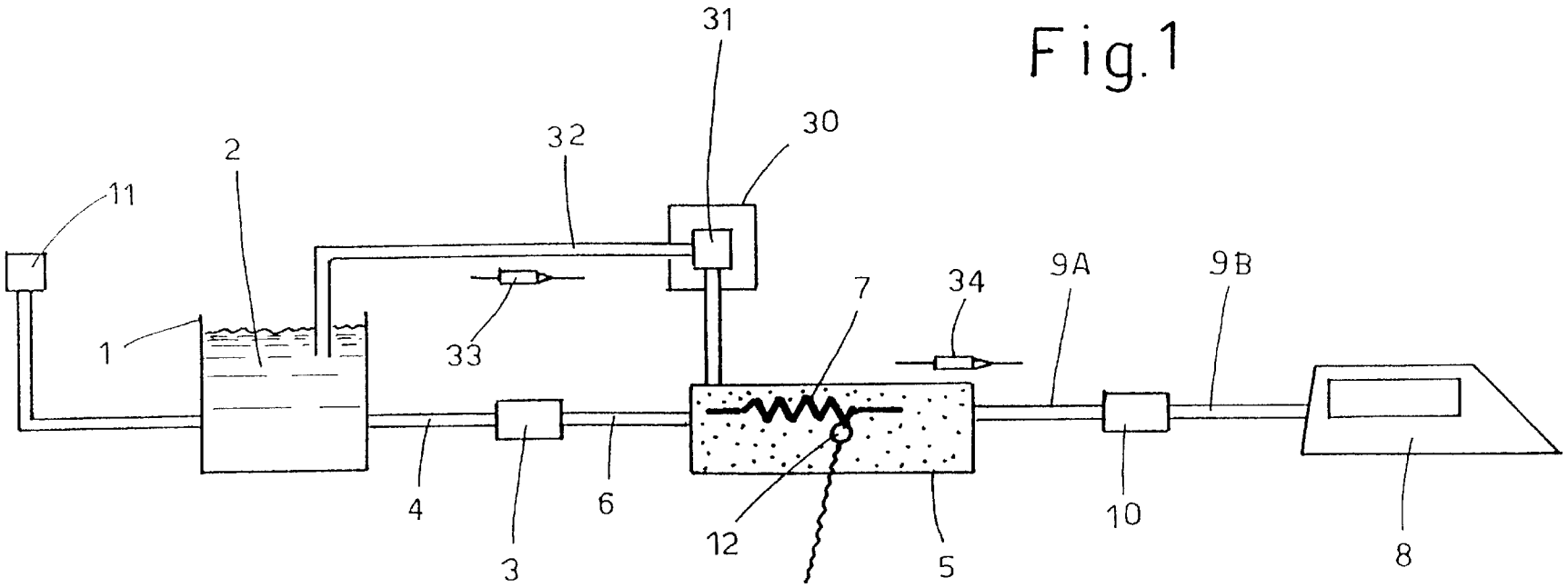
FIG. 1 is a schematic representation illustrating the operation of the apparatus.
Figure 2:
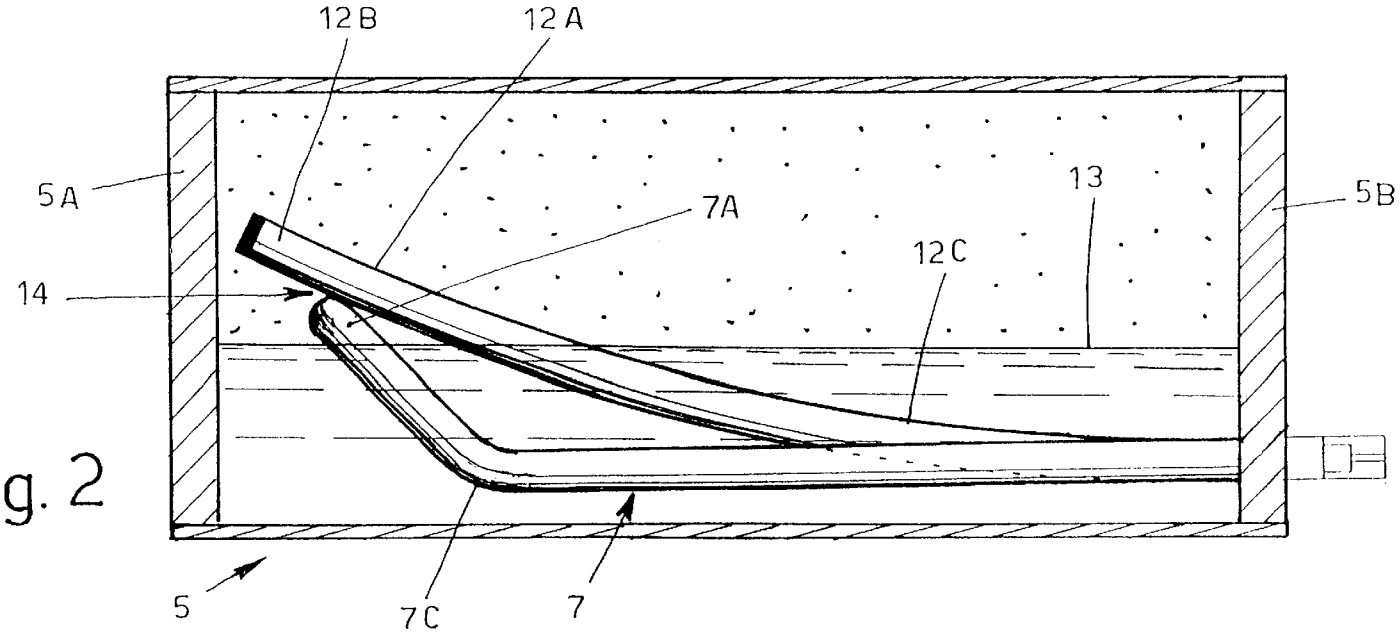
FIG. 2 is a side sectional view of a boiler showing the relationship between the armoured resistance element and a support structure for the temperature sensor.
Figure 3:
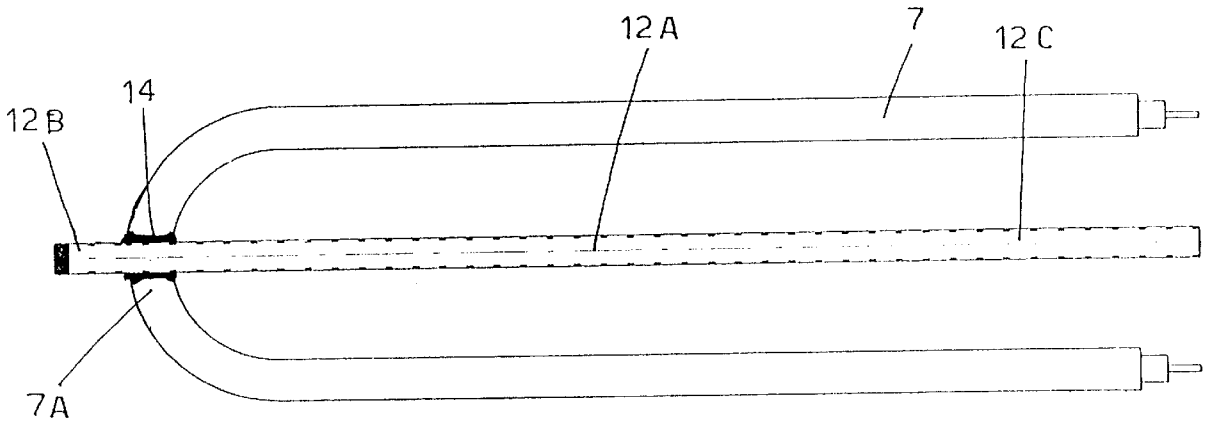
FIG. 3 is a view from above showing only the temperature sensor support structure and the armoured resistance element.
Figure 4:
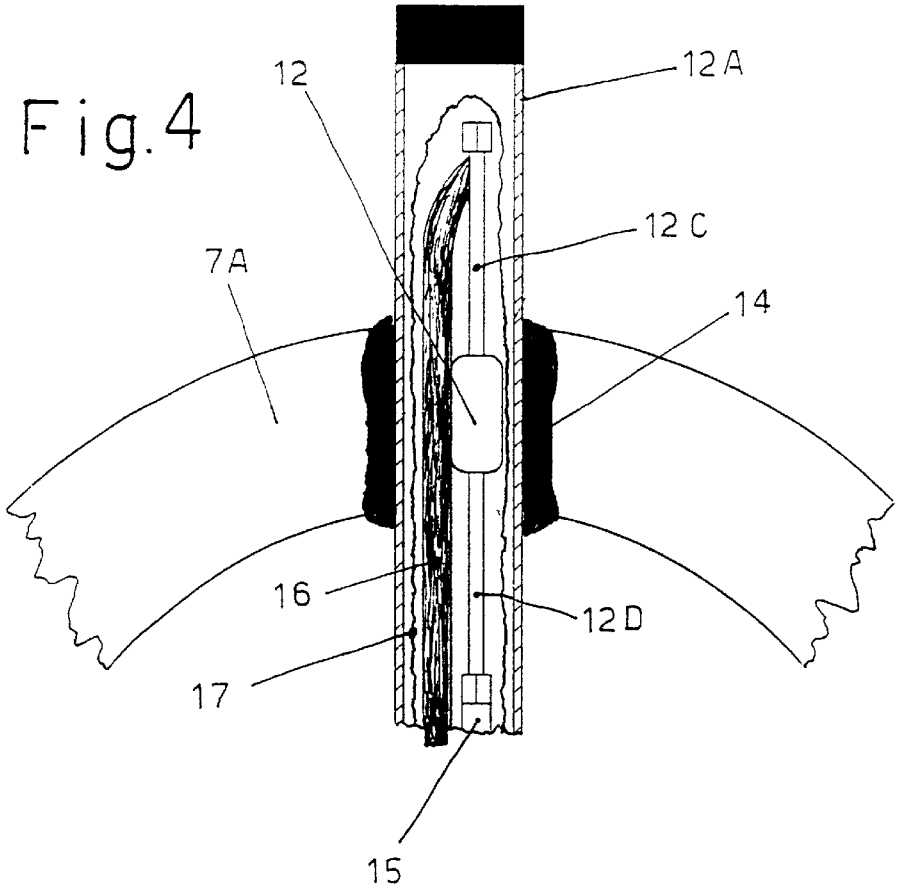
FIG. 4 shows the interior of the temperature sensor support structure in the end region in which the sensor is located.
Figure 5:
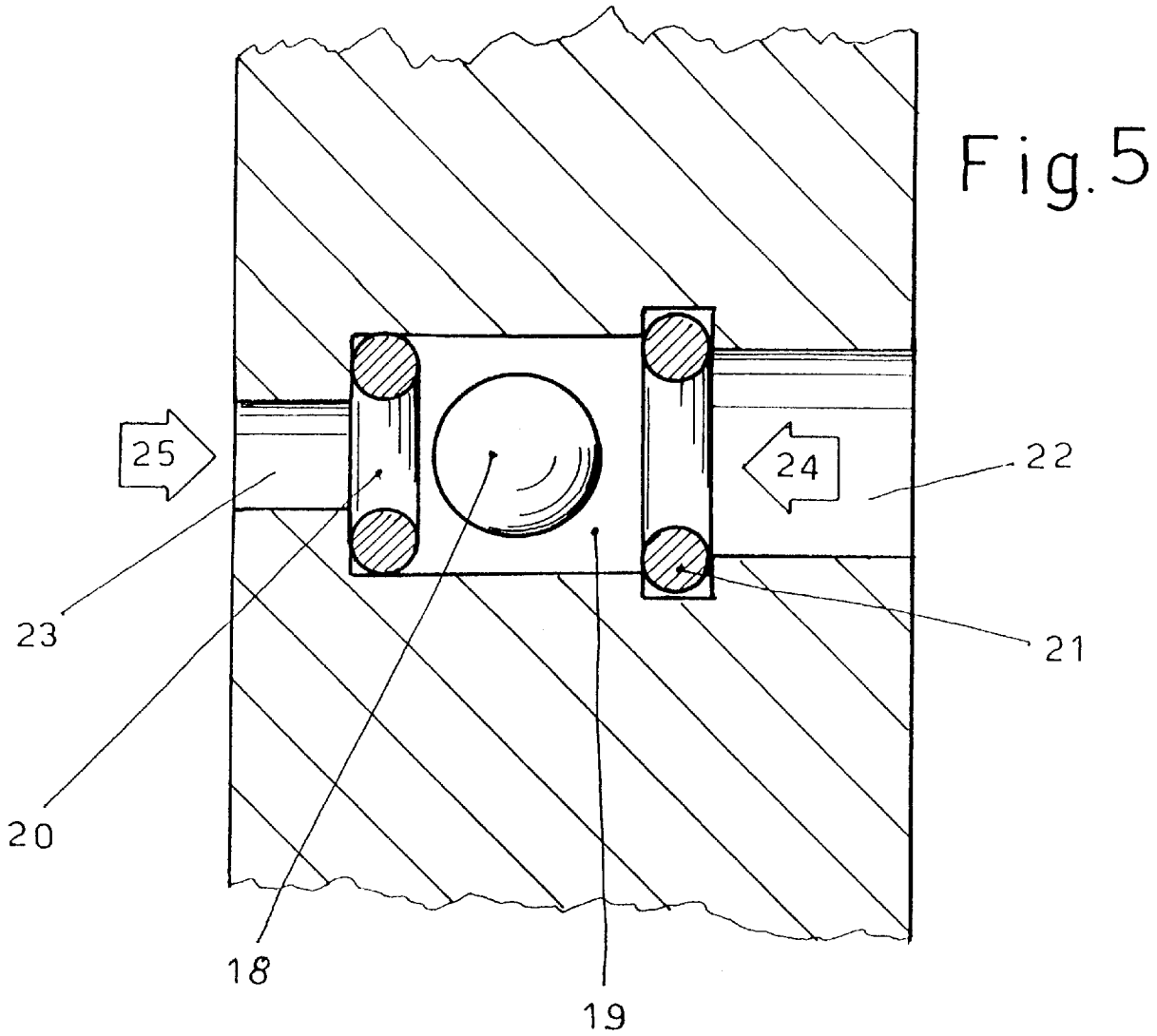
FIG. 5 is a section through one example of a pneumatic floating valve.
Figure 6:
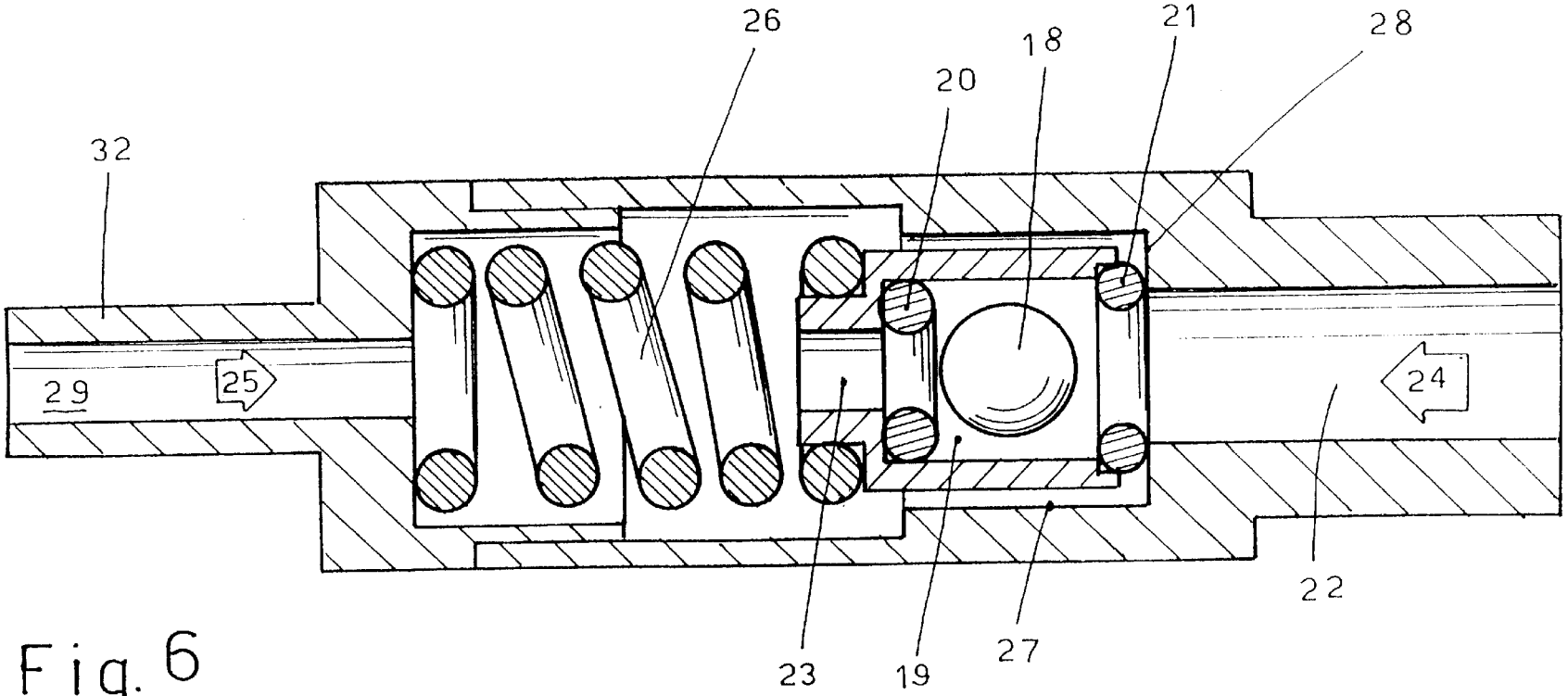
FIG. 6 shows the floating valve of FIG. 5 in combination with a pressure-limiting safety valve.

With reference to FIG. 1, a usual reservoir 1 is provided for containing cold water 2 at atmospheric pressure. It can therefore be constructed of any usual and economical plastic material. An electrical micro-pump 3, for example of the vibration type, draws cold water from said reservoir 1 through a pipe 4 and feeds it into a boiler 5 through a further pipe 6. Within the boiler there operates a usual armoured resistance element 7 provided for heating the contained water to convert it into steam. The boiler is connected to a user appliance 8, for example a smoothing iron, by a pipe comprising a first portion 9A and a second portion 9B, with a manually operated solenoid valve 10 therebetween. Its operation either blocks the steam present in the first portion 9A or enables it to also pass through the second portion 9B, which freely communicates with the exits of the user appliance 8. This takes place not only by manual operation but also automatically by electronic control during the initial preheating stage, to enable the air present in the boiler to be gradually expelled to the outside until a temperature of 95° C. is attained within the boiler. What happens during temperature increase can also take place during temperature decrease, in accordance with electronic expedients either of known kind or as specifically indicated on the accompanying circuit example. Within the reservoir 1 there operates a water level sensor 11, either of the level-switch type, or of the pressure switch type if it senses water presence by hydrostatic pressure. Said sensor is substantially an electrical switch which, before the reservoir 1 is completely empty, interrupts the circuit to deactivate the micro-pump 3 and the armoured resistance element 7. The micro-pump 3 is controlled by a temperature sensor 12 positioned on the highest region 7A (FIG. 2) of the armoured resistance element 7, so that as soon as this region emerges due to the lowering of the water level 13 in the boiler 5, a significant temperature increase occurs thereat and is sensed by said temperature sensor 12. This temperature increase derives from the lower thermal conductivity of steam (which surrounds the emerged part) compared with the thermal conductivity of water (in contact with the immersed part of the armoured resistance element). Consequently, as soon as the emerged part 7A of the armoured resistance element undergoes said temperature rise, the sensor 12 senses it and activates the micro-pump 3, to cause it to feed into the boiler 9 a water quantity sufficient to cause said temperature to fall as a result of an increase in water level sufficient to cover said highest part 7A of the armoured resistance element. Advantageously, by such means the armoured electrical resistance element always operates substantially immersed in water and is not subjected to temperature rises which would endanger its life. Moreover, the water volume available in the boiler does not have to be such as to create a "reserve", as the reserve water quantity (or apparatus self-sufficiency) is available in the boiler 1 in the cold state. This means that the water quantity which needs to be present in the boiler is very small, because as soon as steam is needed, only that water quantity required to produce it need be fed into the boiler. Consequently the armoured electrical resistance element 7 requires a very short time to convert it into steam. This means that said armoured resistance element can be of low rating as the electrical power required to generate said very small steam quantity is small, for example 900 W. The "very small steam quantity" is very small compared with the total requirement, so that the electrical resistance element does not have to produce a large steam quantity to be left unused within the boiler while withdrawing only a very small fraction of it, as usually happens, but instead has to produce only that steam effectively used externally. In a conventional boiler, even on the assumption that all the steam has to be rapidly consumed, there would still remain the drawback of having to halt its operation, refill it with cold water and wait for the entire large water mass to heat up to vaporization temperature. Hence the apparatus of the invention also offers the advantage of no "down-times for heating after filling" typical of usual boilers. A further advantage of the apparatus is that as a large steam quantity can be continuously produced from a boiler of minimum volume, on the one hand the boiler used can have a smaller wall thickness because of the intrinsic material strength laws, and on the other hand there is a smaller danger of explosion because of the lesser elastic energy expressed by the steam contained in its interior. FIGS. 2 and 3 show one example of an armoured resistance element positioned within the boiler 5. It can be seen that an external support structure 12A for the temperature sensor is welded at a contact point 14 to the highest part of the region 7A. This weld can be made by brazing or by other usual methods. Said external structure 12A consists of a stainless steel tube closed at one end 12B by flattening and welding to prevent water or steam being able to penetrate into said tube. A further end 12C is welded to an end 5B of the boiler 5, to which the typical prongs of armoured resistance elements used for such purposes are also welded. By virtue of a bend 7C in the resistance element and an arching of the external support structure 12A for the sensor, the connection between the two parts is durable, notwithstanding the thermal expansion arising during operation. With reference to FIG. 4 it can be seen that within the said external structure tube 12A, the temperature sensor 12, with its electric cables 15 and 16 welded to its ends 12C and 12D, is positioned within a heat-shrinkable plastic sheath 17. This sheath further insulates the sensor 12 and clamps the various parts together to achieve maximum structural stability, so ensuring their prolonged operation with time. From a constructional viewpoint, the boiler 5 is composed of a metal tube 5C with two endpieces screwed or welded to its two ends. To these endpieces there are fixed the prongs of the armoured resistance element 7 and the external armoured 12A for the sensor. The various connectors for connecting the pipe 6 and the pipe 9A (FIG. 1) are also provided on these endpieces. On one of the two endpieces there is mounted a special "floating valve", shown in FIG. 5, consisting of a precision ball 18, rolling within a short horizontal cylindrical conduit 19 bounded by two seal rings 20 and 21 of O-ring type. The ball 18 is arranged to be urged against the seal ring 21 to close an outer hole 22, or be urged against the opposite seal ring 20 to close an inner hole 23, by even a light flow of an aeriform substance. Said aeriform substance can be either environmental air or the air expanding within the boiler following activation of the armoured resistance element 7 when it begins to heat the water. The facility for closing either the outer hole 22 or the inner hole 23 enables this valve to perform the important function of drawing air into the boiler 5 when the boiler has completely cooled after the apparatus has been used. In this respect, in this state there is the tendency inside usual boilers for a vacuum to be created. If said boilers are of the type fed by micro-pumps, there is the drawback that they restore atmospheric within their interior by drawing water from the reservoir via passage through the pump body. Hence a water level arises within the boiler which is higher than that required for correct operation. On next activating the boiler, this level determines delayed heating, with initial spitting of water instead of only steam emission. With the floating valve of FIG. 5 this drawback is eliminated by the said drawing of air in a direction 24 which detaches the ball 18 from the seal ring 21, but without having sufficient energy to urge it to effectively bear against the seal ring 20. Sufficient energy is however possessed by a contrary flow 25 generated by the activation of the armoured resistance element 7. In this respect, this resistance element provides a heating rate of the water and of its containing boiler which is much higher than the cooling rate. There is consequently a considerable rate difference between the two flows, this being therefore used to move the ball 18 within the short conduit 19. This energy difference between the two flows 24 and 25 can obviously also be used in other ways. For example, a rubber ball 18 can be used which seals against the metal edges of the two conduits 22 and 23. If the ball 18 is sufficiently lightweight, said floating valve could also operate with a vertically arranged conduit 19 and with the externally communicating conduit 23 positioned below it so that the vacuum within the boiler causes said lightweight ball to rise. To reduce the holes formed in the boiler endpieces 5A, 5B, the said pneumatic floating valve could be combined with the anti-explosion safety valve provided on all pressure vessels in which the pressure is heat-created. One example of such a combination is shown in FIG. 6. In this it can be seen that the floating valve of FIG. 5 is itself movable within a cylindrical guide 27, it being maintained at rest against the fixed walls 28 by the action of a compression spring 26. In this respect, to cause detachment from the ring 21 and hence allow the pressure to flow towards the external environment 29 it is sufficient for a pressure acting in the direction of the flow 24 to create within the floating valve a force greater than that exerted by the spring 26. In this discharge condition the ball 18 lies against the seal ring 20 to close the hole 23. As soon as within the interior of the boiler (or in the conduit 22) there is a tendency to form a vacuum by cooling, the ball 18 undergoes detachment from the ring 20 to enable the pressure of the external environment to penetrate into the boiler. In FIG. 1 said safety valve is indicated by 30, and the pneumatic floating valve by 31. The valve 30 acts to connect the boiler interior to the external environment when the pressure in the boiler reaches about 4 bar. It is connected by a pipe 32, which returns steam discharged from the boiler into the cold water reservoir 1. In contact with the pipe 32 there is a usual temperature fuse 33 which interrupts electric power to the resistance element 7 when it detects said fault condition by sensing a temperature of about 70° C.

Figure 7:
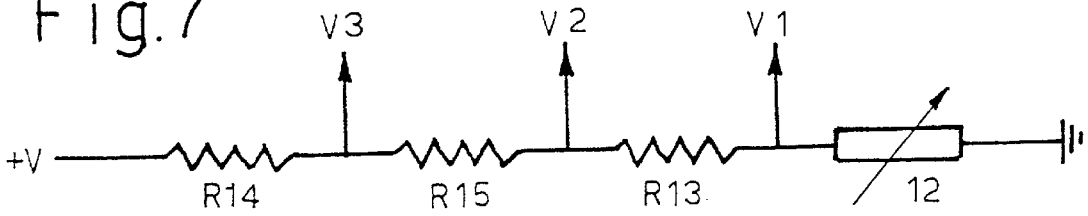
FIG. 7 shows the operating principle of the temperature sensor within the generator.
Figure 8:
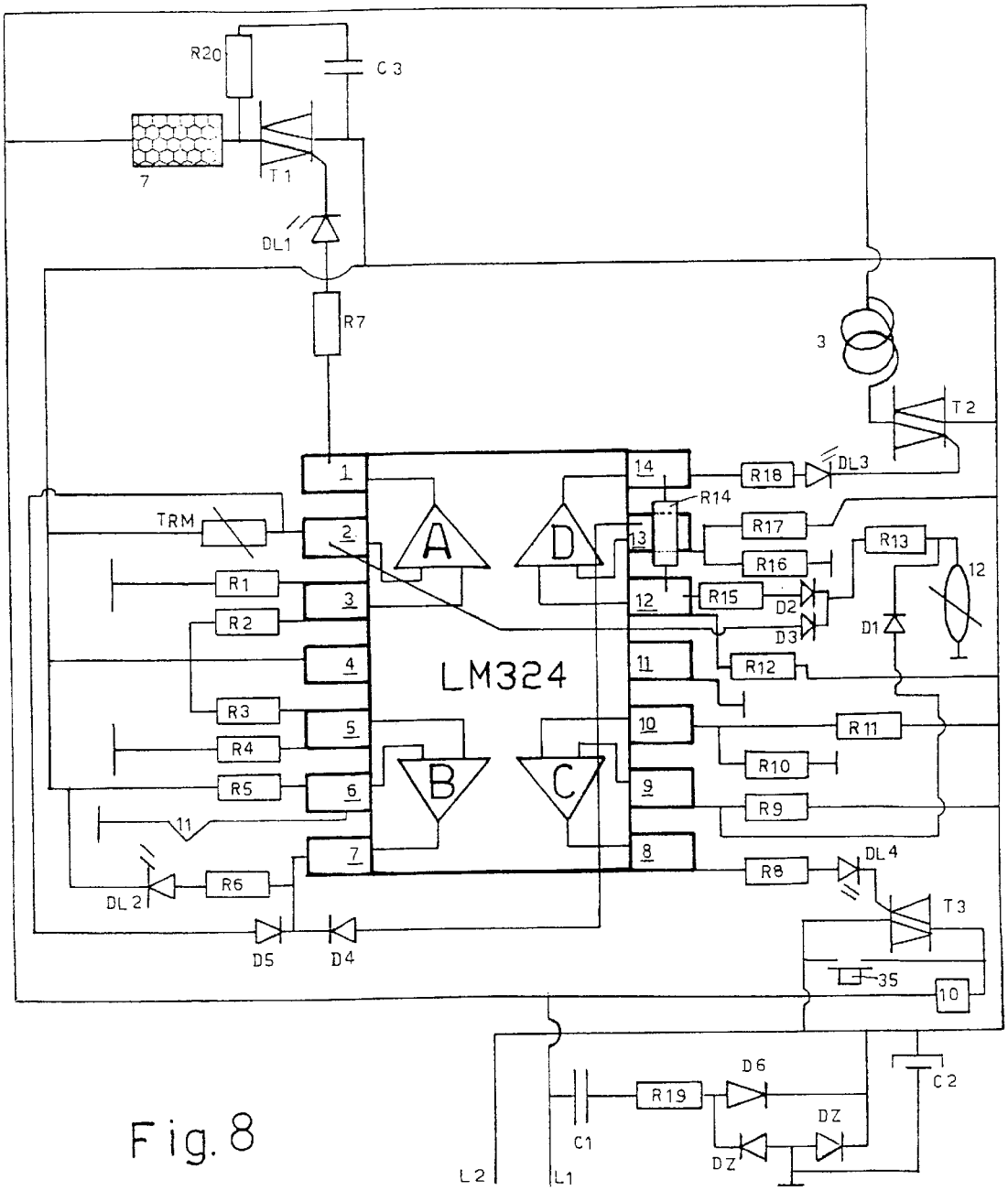
FIG. 8 shows the electronic card which determines the operation of the generator.

The temperature sensor 12 is preferably of the NTC-MURATA 100K-VETRO type, with 1% tolerance, the electrical resistance of which varies considerably with temperature. It operates with three resistors R13, R14, R15 connected in series in order to be able to control three temperature levels by three voltages V1, V2, V3 withdrawn as shown in FIG. 7. The voltage V1, corresponding to a temperature of 95° C., controls a TRIAC which maintains the solenoid valve 10 in the ON configuration. When this temperature is exceeded, the solenoid valve is switched to the OFF configuration. The voltage V2, corresponding to a temperature of 135+ C., controls a TRIAC which establishes the ON-OFF conditions required to achieve a boiler operating pressure of about 2 bar. The voltage V3 corresponds to a temperature of 136° C., occurring as a result of a reduction in the level 13 of the water present in the boiler 5 such as to cause the highest region 7A of the armoured resistance element 7 to emerge. Said voltage V3 hence controls the operation of the micro-pump 3 for a certain ON period which generally lasts only for a few seconds. In this respect, the cold water hence fed into the boiler 5 immediately cools the region 7A, and the sensor support welded to it. The solenoid valve 10 is maintained open by the voltage V1, to allow exit from the boiler of the air which expands during initial heating. For the remaining time during which the apparatus is used, said solenoid valve is controlled by the user by means of a pushbutton (located for example on the smoothing iron), to allow steam to flow from the boiler. With reference to FIG. 1, the reference numeral 34 indicates a second temperature fuse which interrupts the apparatus electrical circuit when an internal boiler temperature of about 170° C. occurs. This prevents a boiler internal pressure higher for example than 10 bar being able to arise due to ineffectiveness of other aforesaid safety devices, but nevertheless much less than the pressure which would cause the boiler 5 to explode. FIG. 8 shows the details of an electronic card appropriate for correct operation of the apparatus. The electronic circuit shown consists of a single LM 324 integrated circuit. On the diagram the four operational circuits are indicated by the letters A, B, C, D. Of these, A, B, C are normally closed whereas D is normally open. The circuits A, C, D are controlled by the sensor 12, of known 100 K NTC type, in cascade via three diodes D1, D2, D3 and two resistors R13, R15. The circuit B is controlled by the level sensor 11 (for example a magnetic switch). In practice, with varying resistance of the NTC sensor, the following occur:

i) action via NTC sensor+D1 at pin 9 (operational circuit C), causing switching (from normally closed to open) of the circuit C in which the solenoid valve 10 for the user appliance (such as a smoothing iron) is connected;

ii) action via NTC sensor+R13+D3 at pin 2; this action switches (from normally closed to open) the circuit A, in which the armoured resistance element 7 of the boiler 5 is connected;

iii) action via NTC sensor+R13+D2+R15 at pin 12 (operational circuit D); this action switches (from normally oven to closed) the circuit D, in which the micro-pump 3 for automatically transferring water from the reservoir 1 to the boiler 5 is connected.

A contactor 11 of a level switch is connected to pin 6 of the operational circuit B; when water is present in the reservoir this is normally closed, whereas when this water is insufficient it switches to open mode. In this mode it acts via the diodes D4 and D5 on the circuits A and D, to interrupt them so as not to enable current to reach either the armoured resistance element 7 or the pump 3. The components used can be specified as follows (R=ohms).

R1, R2, R3, R4, R9, R10, R11, R16, R17=100 K

R5, R12=10 K

R6, R7, R8, R18=330

R13=1500

R14=470 K

R15=220

R19=1500/15 W

R20=100

Trimmer TRM=22 K

D1, D2, D3, D4, D5=1 N 4148

D6=1 N 4007

DZ=V12

C1=2000 nF V400

C2=EL $\mu$F 25 V220

C3=100 nF V400

TRIAC T1=BT 137 600 PH

TRIAC T2, T3=Z0 105 DA

INTEGRATED CIRCUIT=LM 324

Usual light emitting diodes (LEDs) are indicated by DL1, DL2, DL3, DL4.

Figure 9:
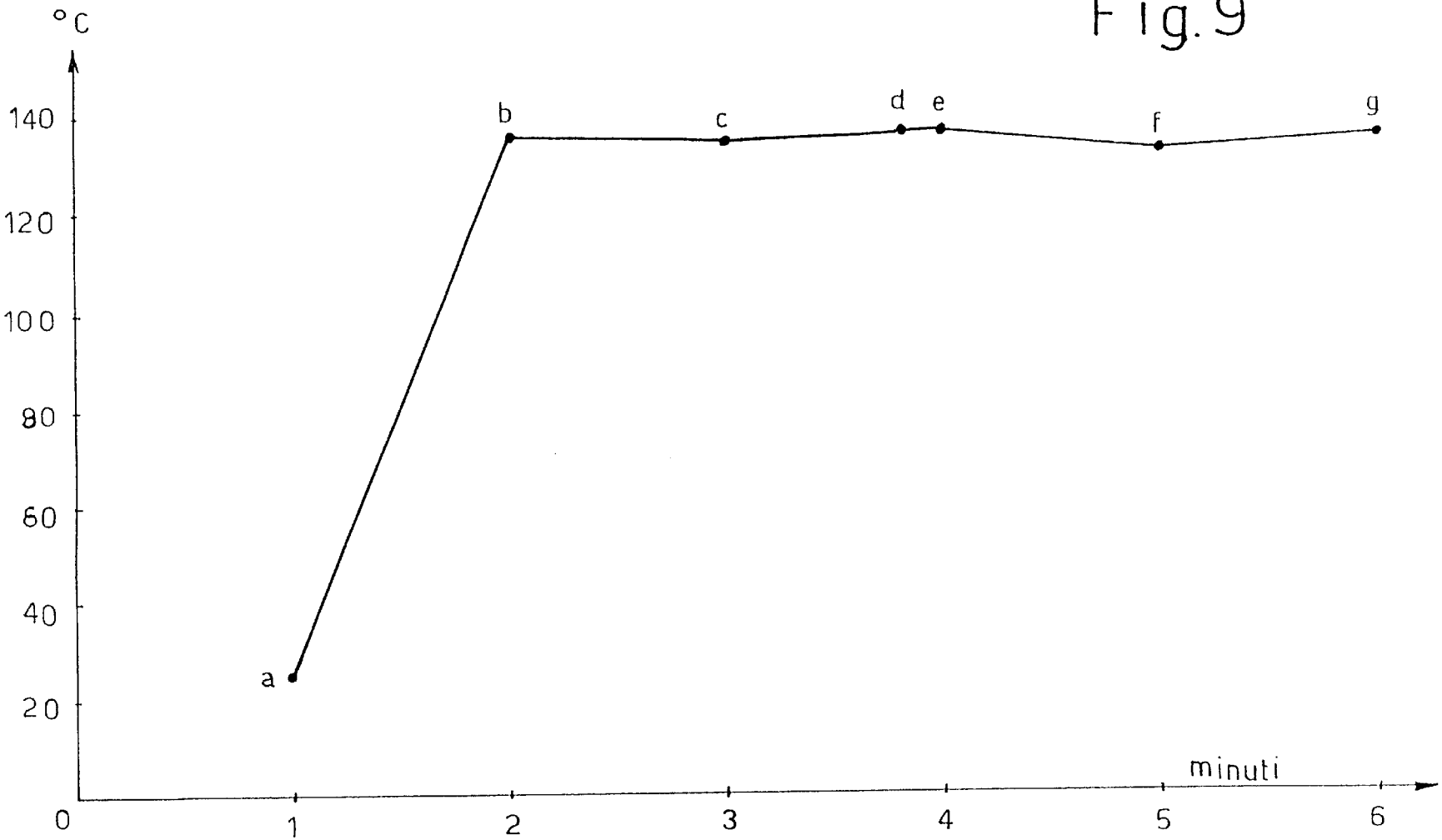
FIG. 9 shows the variation in the boiler temperature with time, as produced by the described electronic control system.

FIG. 9 snows the variation in the boiler temperature with time, as produced by the described electronic control system. It shows a series of points a, b, C, d, e, f, g expressing the various actions, to which the following temperatures and the following values in ohms of the NTC sensor correspond:

a=25° C.=100 K b=135° C.=5 K c=134° C.=5.2 K d=135° C.=5 K e=136° C.=4.7 K f=134° C.=5.2 K g=135° C.=5 K

The micro-pump 3, having indicatively a power of 50 W at 230 V, operates between points d) and e). The armoured resistance element 7 is active between the points a) and b); c) and d); f) and g). It is inactive between the points b) and c); e) and f).

What is claimed is:

1. A household electrical steam generator for supplying steam to an appliance, comprising:

a reservoir for retaining water, a boiler for generating steam, first conduit means for interconnecting said reservoir and said boiler, pump means arranged in connection with said first conduit means for pumping water from said reservoir to said boiler, heating means arranged in said boiler for heating the water pumped from said reservoir to said boiler and converting the water into steam, said heating means comprising a resistor having a main portion lying in a substantially horizontal position in said boiler close to a bottom of said boiler, and an elevated region at a higher level relative to said bottom of said boiler and with respect to said main portion, second conduit means for connecting said boiler to the appliance, a valve arranged in connection with said second conduit means for regulating the flow of steam from said boiler to the appliance through said second conduit means, and regulating means for regulating a water level in said boiler during operation by activating and deactivating said pump means, said regulating means comprising sensing means in engagement with said elevated region of said resistor for sensing temperature in said boiler.

2. The steam generator of claim 1, wherein said sensing means comprise a tubular support structure welded onto said elevated region of said resistor and a temperature sensor housed within said tubular support structure.

3. The steam generator of claim 2, wherein said temperature sensor has a low temperature characteristic, a middle temperature characteristic and a high temperature characteristic, said temperature sensor being coupled to said pump means and to said valve such that said valve is opened when said temperature sensor senses a temperature below the low temperature characteristic, said pump means is activated when said temperature sensor senses a temperature higher than the high temperature characteristic, said pump means is deactivated when said temperature sensor senses a temperature below the middle temperature characteristic.

4. The steam generator of claim 1, further comprising:

a floating valve operably connected to said boiler.

5. The steam generator of claim 4, wherein said floating valve comprises a cylindrical conduit having first and second end openings, said first and second end openings having first and second seal rings, respectively.

6. The steam generator of claim 5, wherein said floating valve further comprises:

a shutter movable within said cylindrical conduit between said first and second end openings and alternately forming a seal with one of said first and second end openings upon engaging a respective one of said first and second seal rings.

7. The steam generator of claim 1, wherein the steam appliance is a smoothing iron.

8. The steam generator of claim 1, wherein said valve is an electric valve.

9. The steam generator of claim 1, wherein said first conduit means comprise a first pipe connected to said reservoir and a second pipe connected to said boiler and said pump means comprise a pump arranged between said first and second pipes.

10. The steam generator of claim 1, wherein said second conduit means comprise a first pipe portion connected to said boiler and a second pipe portion adapted to be connected to the appliance and said valve is arranged between said first and second valve portions.

11. A household electrical steam generator for supplying steam to an appliance, comprising:

a reservoir for retaining water, a boiler for generating steam, first conduit means for interconnecting said reservoir and said boiler, pump means arranged in connection with said first conduit means for pumping water from said reservoir to said boiler, heating means arranged in said boiler for heating the water pumped from said reservoir to said boiler and converting the water into steam, second conduit means for connecting said boiler to the appliance, a valve arranged in connection with said second conduit means for regulating the flow of steam from said boiler to the appliance through said second conduit means, and regulating means for regulating a water level in said boiler during operation by activating and deactivating said pump means, said regulating means comprising sensing means for sensing temperature in said boiler, a floating valve operably connected to said boiler, said floating valve comprising a cylindrical conduit having first and second end openings, said first and second end openings having first and second seal rings, respectively.

12. The steam generator of claim 11, wherein said heating means comprise a resistor having a main portion lying in a substantially horizontal position in said boiler close to a bottom of said boiler, and an elevated region at a higher level relative to said bottom of said boiler and with respect to said main portion.

13. The steam generator of claim 12, wherein said sensing means are in engagement with said elevated region of said resistor.

14. The steam generator of claim 13, wherein said sensing means comprise a tubular support structure welded onto said elevated region of said resistor and a temperature sensor housed within said tubular support structure.

15. The steam generator of claim 14, wherein said temperature sensor has a low temperature characteristic, a middle temperature characteristic and a high temperature characteristic, said temperature sensor being coupled to said pump means and to said valve such that said valve is opened when said temperature sensor senses a temperature below the low temperature characteristic, said pump means is activated when said temperature sensor senses a temperature higher than the high temperature characteristic, said pump means is deactivated when said temperature sensor senses a temperature below the middle temperature characteristic.

16. The steam generator of claim 11, wherein said floating valve further comprises:

a shutter movable within said cylindrical conduit between said first and second end openings and alternately forming a seal with one of said first and second end openings upon engaging a respective one of said first and second seal rings.

17. The steam generator of claim 11, wherein the steam appliance is a smoothing iron.

18. The steam generator of claim 11, wherein said valve is an electric valve.

19. The steam generator of claim 11, wherein said first conduit means comprise a first pipe connected to said reservoir and a second pipe connected to said boiler and said pump means comprise a pump arranged between said first and second pipes.

20. The steam generator of claim 11, wherein said second conduit means comprise a first pipe portion connected to said boiler and a second pipe portion adapted to be connected to the appliance and said valve is arranged between said first and second valve portions.

* * * * *